US008439053B2

(12) United States Patent
Krzycki

(10) Patent No.: US 8,439,053 B2
(45) Date of Patent: May 14, 2013

(54) PAINT CADDY

(76) Inventor: Don Krzycki, Bryan, OH (US)

( * ) Notice: Subject to any disclaimer, the term of this patent is extended or adjusted under 35 U.S.C. 154(b) by 0 days.

(21) Appl. No.: 13/427,451

(22) Filed: Mar. 22, 2012

(65) Prior Publication Data

US 2012/0240967 A1 Sep. 27, 2012

Related U.S. Application Data

(60) Provisional application No. 61/466,744, filed on Mar. 23, 2011.

(51) Int. Cl.
*B08B 3/00* (2006.01)

(52) U.S. Cl.
USPC ..... 134/151

(58) Field of Classification Search ..... 68/213; 134/152, 153, 900
See application file for complete search history.

(56) References Cited

U.S. PATENT DOCUMENTS

| | | | | |
|---|---|---|---|---|
| 3,732,593 | A * | 5/1973 | Habostad | 15/257.06 |
| 4,641,673 | A | 2/1987 | Conley et al. | |
| 4,672,987 | A | 6/1987 | Brandt | |
| 4,746,042 | A | 5/1988 | King | |
| 5,072,868 | A | 12/1991 | Dickie et al. | |
| 5,095,928 | A * | 3/1992 | Phipps | 134/138 |
| 5,097,967 | A | 3/1992 | Sica | |
| 5,337,769 | A * | 8/1994 | Howe | 134/138 |
| 5,641,007 | A | 6/1997 | Falk | |
| 5,829,603 | A | 11/1998 | Martineau | |
| 5,839,459 | A | 11/1998 | Bisby | |
| 6,345,636 | B1 * | 2/2002 | Christian | 134/140 |
| 6,578,590 | B2 * | 6/2003 | Leblond | 134/99.2 |
| 7,325,557 | B2 | 2/2008 | Wallace, III | |

FOREIGN PATENT DOCUMENTS

| | | | |
|---|---|---|---|
| DE | 296 11 307 | * | 11/1996 |
| FR | 2 941 889 | * | 2/2010 |
| JP | 11-114479 | * | 4/1999 |

OTHER PUBLICATIONS

WIPO WO 90/11900.*

* cited by examiner

*Primary Examiner* — Michael Barr
*Assistant Examiner* — David Cormier

(57) ABSTRACT

An apparatus for cleaning and storing painting tools is disclosed. The apparatus comprises a bucket member having a bottom wall and a side wall extending vertically from the bottom wall to an upper periphery wherein the side wall surrounds an open cavity. The apparatus also comprises a manifold nested within the bucket member. The manifold substantially bifurcates the open cavity into a first volume within the manifold and a second volume between the side wall and the manifold. The manifold extends vertically between an upper end disposed closer to the upper periphery than the bottom wall and a lower end disposed closer to the bottom wall than the upper periphery. The apparatus comprises at least one retaining member projecting into the second volume from one of the side wall and the manifold. The apparatus comprises at least one drain extending through one of the bottom wall and the side wall.

13 Claims, 5 Drawing Sheets

PAINT CADDY

CROSS-REFERENCE TO RELATED APPLICATIONS

This application claims the benefit of U.S. Provisional Patent Application Ser. No. 61/466,744 for a PAINT CADDY, filed on Mar. 23, 2011, which is hereby incorporated by reference in its entirety.

BACKGROUND OF THE INVENTION

1. Field of the Invention

The invention relates to structures designed to support articles having an elongated portion when the articles are stored or in nonuse and more particularly a support for suspending an article having a handle and working bristles or other flexible working surface.

2. Description of Related Prior Art

U.S. Pat. No. 5,641,007 discloses a PAINT BRUSH AND ROLLER DRAINING DEVICE. The device can support a plurality of paint brushes and/or paint rollers and enable them to drain. The device includes a housing having rear wall component and a container component. The container includes a bottom surface which is tapered inwardly toward a draining aperture. This draining aperture can be connected to a receptacle by way of a length of tubing. The user of the device can support it upon a wall or upon the edge of a bath tub. A number of brushes and/or paint rollers can then be supported within the container portion of the device and have any paint dripping therefrom run off into the bottom surface of the container through the tube and into a receptacle for disposal or reuse.

SUMMARY OF THE INVENTION

In summary, the invention is an apparatus for cleaning and storing painting tools. The apparatus comprises a bucket member having a bottom wall and a side wall extending vertically from the bottom wall to an upper periphery wherein the side wall surrounds an open cavity. The apparatus also comprises a manifold nested within the bucket member. The manifold substantially bifurcates the open cavity into a first volume within the manifold and a second volume between the side wall and the manifold. The manifold extends vertically between an upper end disposed closer to the upper periphery than the bottom wall and a lower end disposed closer to the bottom wall than the upper periphery. The apparatus also comprises at least one retaining member projecting into the second volume from one of the side wall and the manifold. The apparatus also comprises at least one drain extending through one of the bottom wall and the side wall.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
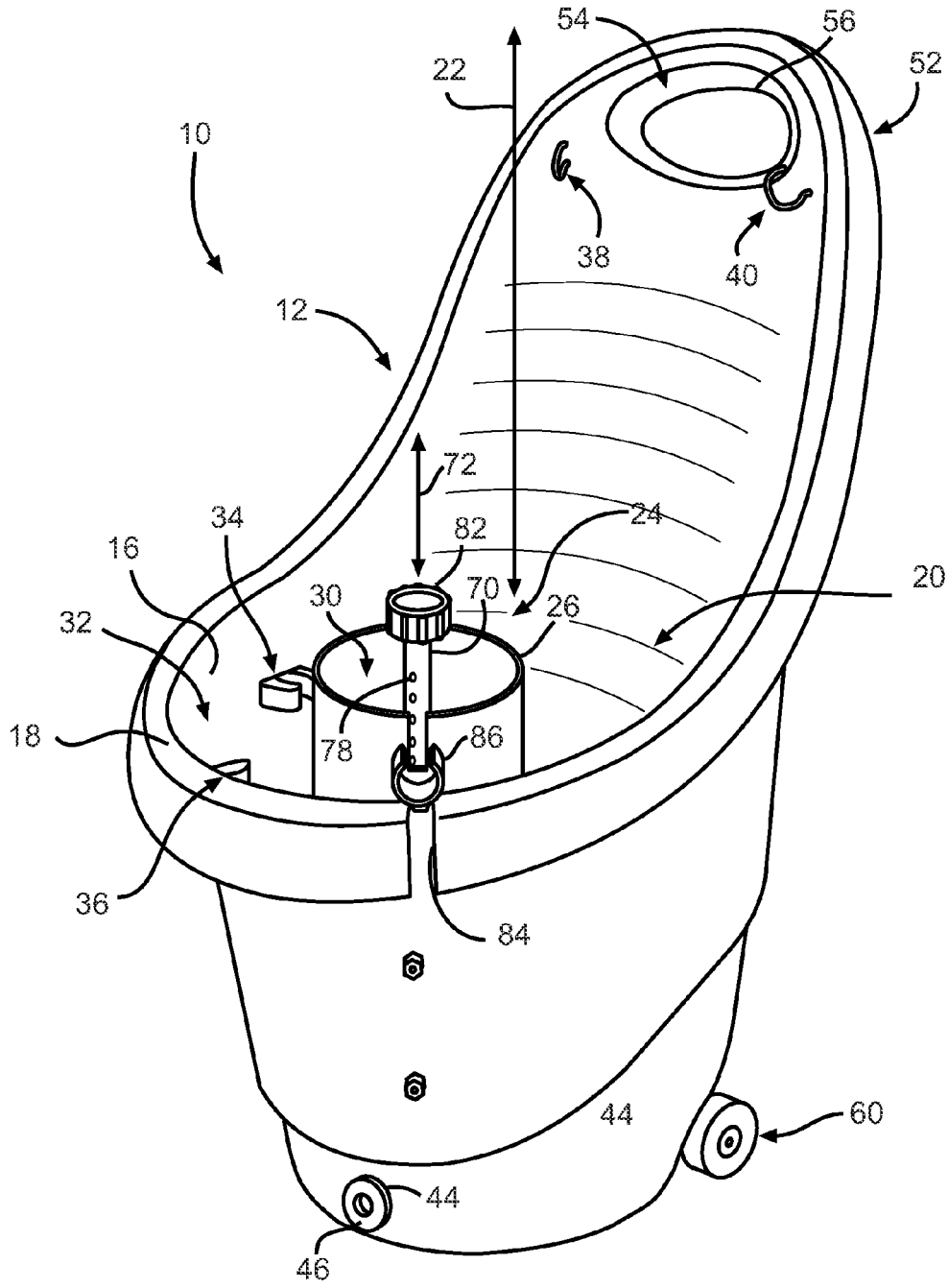
FIG. 1 is a perspective view of an exemplary embodiment of the invention.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

The invention, as demonstrated by the exemplary embodiments described below, provides an apparatus for cleaning and storing painting tools. The exemplary embodiments are designated as a paint caddy. Painting tools such as brushes, rollers, and any other tool that can become at least partially coated with paint and requires cleaning can be cleaned and stored with the paint caddy.

Figure 2:
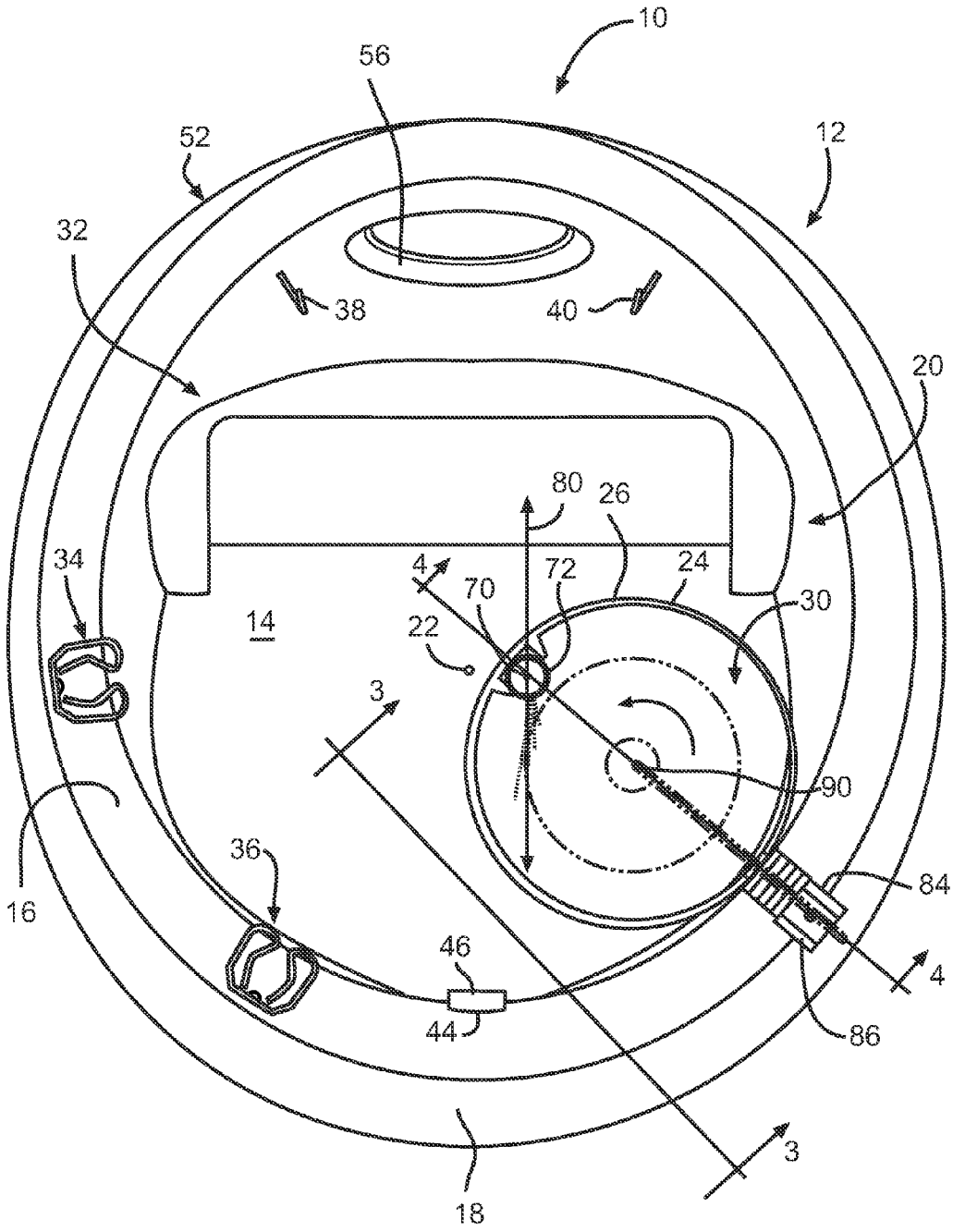
FIG. 2 is a top view of the exemplary embodiment of the invention.
Figure 3:
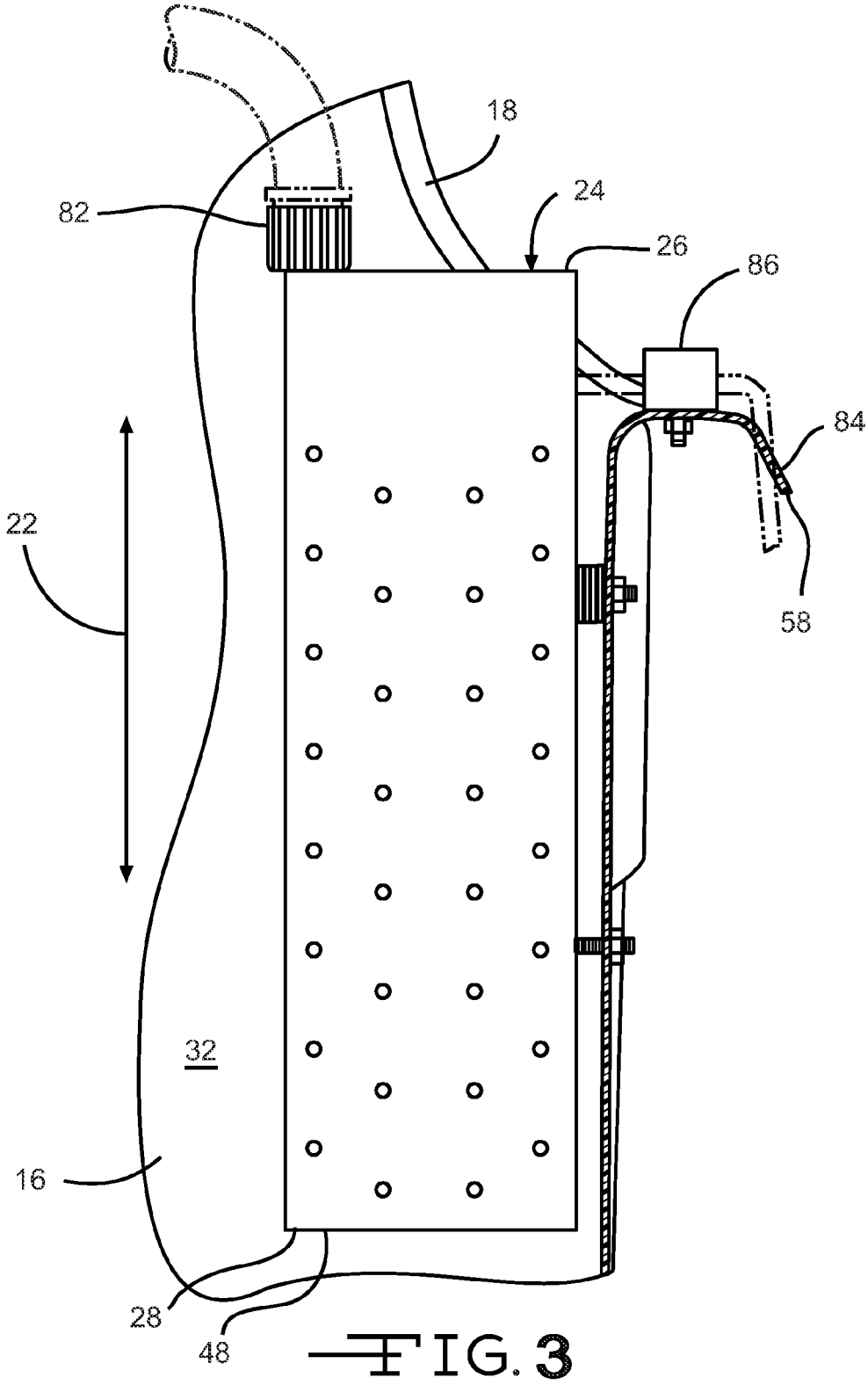
FIG. 3 is a partial cross-sectional view taken through section lines 3-3 in FIG. 2.

A first exemplary embodiment of the invention is shown in FIGS. 1 and 2 as a paint caddy 10. The paint caddy 10 includes a bucket member 12 having a bottom wall 14 and a side wall 16 extending vertically from the bottom wall 14 to an upper periphery 18 wherein the side wall 16 surrounds an open cavity 20. The bucket member 12 can be any shape/cross-section that is desired. It can be desirable that the side wall 16 define the open cavity 20 to be wide enough to accept a paint pan. The bottom wall 14 and side wall 16 can be integrally-formed with respect to one another. "Integrally-formed" refers to the fact that in the exemplary embodiment the bucket member 12 and the side wall 16 are formed together rather than being formed separately and then subsequently joined. The term defines a structural feature since structures that are integrally-formed are structurally different than structures that are comprised of subcomponents formed separately and then subsequently joined. "Integral" means consisting or composed of parts that together constitute a whole and thus encompasses structures of more than one part wherein the parts are either integrally-formed or formed separately and then subsequently joined.

Figure 6:
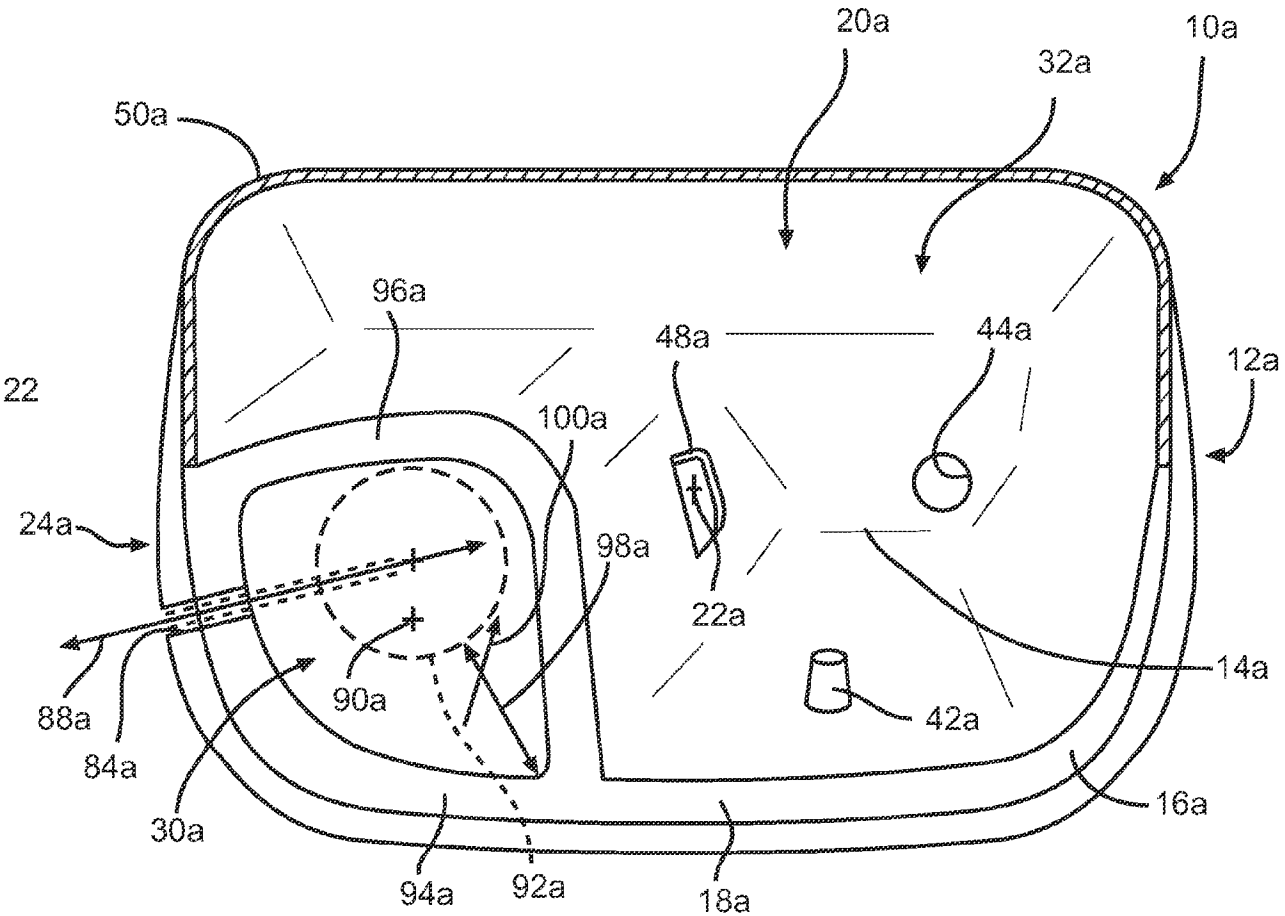
FIG. 6 is a partial top view of another embodiment of the invention.

The open cavity 20 can extend from the bottom wall 14 to the upper periphery 18 along a vertically-oriented bucket axis 22. As used herein, "vertical" and other directional terms are referenced based on the operation of the exemplary embodiment. For example, the bottom wall 14 can be closer to the ground than the upper periphery 18 when the paint caddy 10 is being used and the distance between the bottom wall 14 and the upper periphery 18 is a vertical distance. Cross-sections of the open cavity 20 can be defined in planes perpendicular to the bucket axis 22. The open cavity 20 can be at least partially non-circular in a plurality of the cross-sections. FIGS. 2 and 6 show alternative embodiments of the invention in which a rear side of the paint caddy is generally squared while a front side is generally arcuate. This shape can be useful so that the open cavity 20 can receive a paint pan. The open cavity 20 could also be at least partially circular in a plurality of the cross-sections in embodiments of the invention. Embodiments of the invention can be practiced in which the open cavity is perfectly cylindrical.

FIG. 6 shows an embodiment of the invention in which a paint caddy 10*a* includes an open cavity 20*a*. The open cavity 20*a* includes a plurality of differently shaped cross-sections along its bucket axis 22*a*. The various cross-sections can enhance the flow of fluid out of the open cavity 20*a* for drainage. The surfaces defining the open cavity 20*a* can converge at the bottom wall 14*a*.

Figure 4:
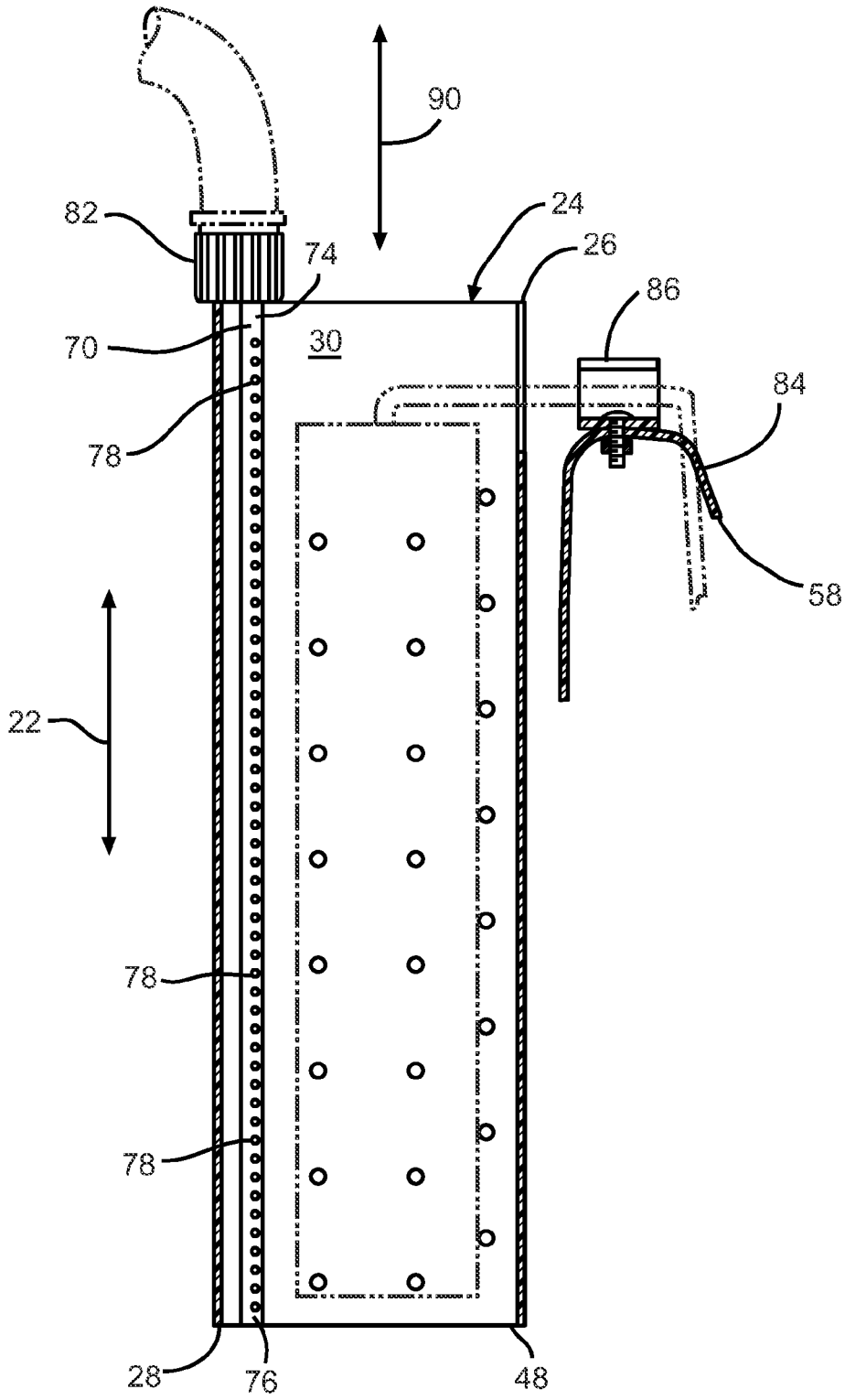
FIG. 4 is a partial cross-sectional view taken through section lines 4-4 in FIG. 2.

The paint caddy 10 also includes a manifold 24 nested within the bucket member 12. The manifold 24 substantially bifurcates the open cavity 20 into a first volume within the manifold 24 and a second volume between the side wall 16 and the manifold 24. As used herein, "substantially bifurcates" refers to the fact that the manifold 24 separates the open cavity 20 into two or more portions substantially separate from one another. The divided volumes can remain in fluid communication with one another. The manifold 24 extends vertically between an upper end 26 disposed closer to the upper periphery 18 than the bottom wall 14 and a lower end 28 disposed closer to the bottom wall 14 than the upper periphery 18. The exemplary manifold 24 can be cylindrical and sized large enough to receive a paint roller (show in phantom in FIGS. 2, 4 and 6).

The paint caddy 10 also includes at least one retaining member projecting into the second volume 32 from one of the side wall 16 and the manifold 24. The retaining member can retain a paint brush or other painting tool suspended above the bottom wall 14 to drip-dry. The retaining member can take numerous different forms. The exemplary retaining members 34, 36 are clamps or clasps for retaining the handle of a painting tool. FIG. 6 shows an exemplary retaining member 42*a* being a pin or post or protuberance for being received in an aperture of the handle of a painting tool.

The paint caddy 10 also includes at least one drain 44 extending through one of the bottom wall 14 and the side wall 16. The bottom wall 14 and/or side wall 16 can be shaped to converge toward the drain 44. A selectively removable plug 46 is shown closing the drain 44 in FIG. 1. Embodiments of the invention can include multiple drains, such as a dedicated drain for each volume. Alternatively, embodiments of the invention can include one or more apertures placing the various volumes in fluid communication with one another to share a common drain. In the first exemplary embodiment, the lower end 28 of the manifold 24 can be open and define an aperture 48 placing the first and second volumes 30, 32 in fluid communication with one another to share the drain 44. In the second exemplary embodiment, an aperture 48*a* places the first and second volumes 30*a*, 32*a* in fluid communication with one another to share the drain 44*a*.

As shown in FIG. 6, embodiments of the paint caddy 10*a* can include a bucket member 12*a* and a manifold 24*a* and at least one retaining member 42*a* and at least one drain 44*a* that are integrally-formed with respect to one another. Such a single structure can be molded to form all of these substructures. The side wall 16*a* can define a portion of the manifold 24*a*. An interior surface of the manifold 24*a* can extend vertically straight over most of its height and converge toward the aperture 48*a* at the bottom of the first volume 30*a*. In other embodiments of the invention, the bucket member and the manifold and the at least one drain can be integrally-formed with respect to one another and the at least one retaining member can be mounted on the side wall or the manifold. For example, the retaining member 34 of the first embodiment could be mounted in the side wall 16*a* of the second embodiment to create a third embodiment. In still other embodiments, more structures can be separately-formed and then connected together. In the first embodiment, the bucket member 12 and the manifold 24 are separately-formed and connected together.

Embodiments of the invention can include a splash guard 52 projecting vertically from the side wall 16 about less than all of the upper periphery 18. FIG. 1 shows that the first embodiment can include a splash guard 52 that extends about one-third to one-half of the upper periphery 18. FIG. 6 shows a boundary 50*a* between a splash guard 52 (not shown) and an upper periphery 18*a*. The splash guard 52 and the upper periphery 18*a* are integrally-formed in the second exemplary embodiment, so the boundary 50*a* is shown in cross-section. Cleaning fluid such as water can be sprayed into the paint caddy 10 in direction extending toward the splash guard 52. The splash guard 52 can thus limit the amount of fluid escaping the paint caddy 10 during spraying. At least one retaining member can be mounted in the splash guard 52. In the first embodiment, exemplary retaining members 38, 40 are hooks for being received in an aperture of the handle of a painting tool. The hooks 38, 40 project outwardly from the splash guard 52 to extend above the open cavity 20.

The splash guard 52 can also define a handle portion 54 for moving the paint caddy 10 or positioning the paint caddy 10 for suspended storage, such as on a wall, shelving unit, or rack. The exemplary handle portion 54 is an aperture 56. Alternative embodiments can include other forms of handle portion 54, such as a peripheral lip. The exemplary paint caddy 10 also includes a peripheral lip 58 that could be used as handle or gripping portion.

In operation, the second volume 32 can be filled with cleaning fluid such as water or some other fluid. Painting tools such as paint brushes can be cleaned in the fluid. The plug 46 can be removed to allow the fluid to be evacuated from the second volume 32 through the drain 44. The painting tools can then be mounted on the retaining members 34, 36, 38, 40 as needed and thereby suspended for drip-drying.

Figure 5:
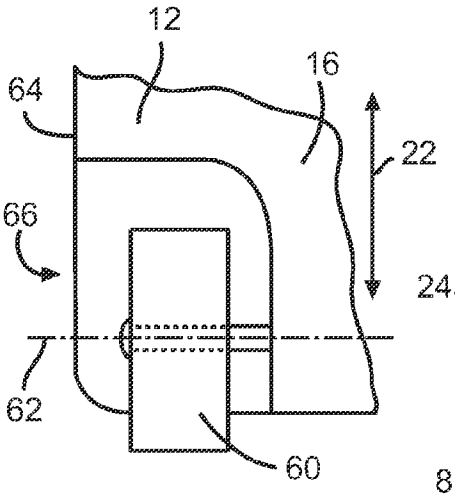
FIG. 5 is a partial rear view of the exemplary embodiment of the invention showing an arrangement of a wheel in a recessed portion.

In some operating environments, it can be desirable or may be necessary to move the paint caddy 10 during the cleaning process. A place where the paint caddy 10 is filled with fluid can be spaced from the place where the fluid is to be drained. The exemplary paint caddy 10 can include at least one wheel 60 supporting the bucket member 12 for movement. The exemplary paint caddy 10 includes two wheels on opposite lateral sides of the bucket member 12 (one wheel is not visible in the drawings). As shown in FIG. 5, the exemplary wheel 60 can have an axis 62 of rotation fixed with respect to the bucket member 12. In alternative embodiments of the invention, a paint caddy can include wheels mounted on casters.

In the exemplary paint caddy 10, the side wall 16 includes an outer surface 64 and a portion 66 opposite the open cavity 20. The portion 66 is on the outside of the side wall 16 relative to the open cavity 20. The portion 66 is recessed from the outer surface 64. The portion 64 defines a pocket or cavity and the wheel 60 is disposed in the portion 64. As result, an outer wall 68 of the wheel 60 is flush with or recessed from the outer surface 64. In the exemplary embodiment, the outer wall 68 is recessed from the outer surface 64. Positioning the wheel 60 in this manner can reduce the likelihood the wheel will be damaged and will simplify storage of the paint caddy 10 when not in use.

Embodiments of the invention can also be used to clean paint rollers. A paint roller can be received in the first volume 30 or 30*a* for cleaning. The exemplary manifolds 24 and 24*a* can be generally cylindrical and sized large enough to receive a paint roller. In the first embodiment of the invention, the paint caddy 10 can include a dispersion tube 70 mounted within the manifold 24. The dispersion tube 70 extends along a length axis 72 between first and second ends 74, 76. The first end 74 is disposed closer to the upper end 26 of the manifold 24 than the lower end 28 and the second end 76 is disposed closer to the lower end 28 than the upper end 26. A plurality of orifices 78 extend through the dispersion tube 70. Each orifice 78 is directed along a dispersion axis 80 that is transverse to the length axis 72. The dispersion axes of the orifices can be parallel to one another. A fluid fitting 82 is positioned at the first end 74 of the dispersion tube 70.

In operation, a hose such as a garden hose can be engaged with the fluid fitting 82. Water directed through the hose and the fluid fitting 82 can be received in the dispersion tube 70 and ejected through the orifices 78. The orientation of the orifices 78 relative to the position of the paint roller can cause the roller to spin and cause paint to be cleaned off of the roller. This spray is shown in FIG. 2.

Embodiments of the invention can include a notch 84 defined in the upper periphery 18 adjacent to the manifold 24. The exemplary notch 84 extends substantially perpendicular to the upper periphery 18, but in alternative embodiments the notch could extend transverse but less than perpendicular to the upper periphery 18. The notch 84 can receive a portion of a paint roller handle to increase the likelihood that the roller will be maintained in a desired position and orientation within the first volume 30 during cleaning. The notch 84 can be shaped to enhance the rigidity of the interconnection between the notch 84 and the paint roller handle. For example, the notch 84 can be v-shaped. Alternatively, the notch 84 can include deformable fingers that releasibly pin a portion of the paint roller handle against the edge of the notch 84. Alternatively, an elastomeric edge guard can be placed over the edges of the notch 84 to grip the paint roller handle. The first embodiment of the invention also includes a ring member 86 operable to receive a portion of a paint roller handle and increase the likelihood that the roller will be maintained in a desired position and orientation within the first volume 30 during cleaning. In the first embodiment, the paint roller handle can thus be held at two locations of the handle that are spaced from one another.

In an alternative approach to cleaning a roller, the manifold can be arranged relative to the bucket member such that a hose can be directed down the first volume, obviating the need for a dispersion tube. In FIG. 6, a notch 84*a* extends along a horizontal axis 88*a* that is spaced from a central vertical axis 90*a* of the manifold 24*a*. The vertical axis 90*a* is substantially centered with respect to the first volume 30*a*. Thus, the position of the roller 92*a* within the first volume 30*a* is shifted from center to create a larger gap with a first portion 94*a* of the manifold 24*a* than with a second portion 96*a* of the manifold 24*a*. The gap between the first portion 94*a* and the roller 92*a*, referenced at 98*a*, can be large enough to allow a garden hose with a nozzle to spray a stream of water along the entire width (defined along the axis 90) of the roller 92*a*. A water stream can be directed in a direction referenced at 100*a* to cause cleaning and spinning of the roller 92*a*. The nozzle of the garden hose would not need to extend into the first volume 30*a* in order to direct water along the entire width of the roller 92*a*.

Embodiments of the invention can vary the relative positions of the manifold and the bucket portion. In the first embodiment, the manifold 24 is substantially centered on a manifold axis 90 extending vertically between the upper and lower ends 26, 28. The side wall 16 is substantially centered on the bucket axis 22 extending vertically between the bottom wall 14 and the upper periphery 18. The manifold axis 90 and the bucket axis 22 can be spaced laterally from one another. In other embodiments of the invention, the axes 22 and 90 can be collinear.

Another advantage of the exemplary embodiments is that painting tools can be stored in one of the volumes of the open cavity while painting tools can be cleaned in another volume. For example, a roller can be positioned and cleaned in the manifold while brushes are suspended in the second volume and not sprayed with paint or fluid. Likewise, paint brushes can be cleaned in the second volume while a clean roller is disposed in the first volume and is not subjected to cleaning fluid or paint.

Another feature that can be incorporated with embodiments of the invention is a threaded spigot associated with the drain. It has been noted that embodiments with wheels can be easily moved to a drainage location. A feature that can be included in an embodiment with or without wheels is a spigot mounted in the drain. The spigot can include a valve that can be closed to keep fluid in the bucket member. The spigot can also include a threaded portion disposed outside of the open cavity. A hose can be threadingly and sealingly engaged with the threaded portion of the spigot. The hose can extend to a drainage point and the valve opened to drain the bucket member over a distance.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

What is claimed is:

1. An apparatus for cleaning and storing painting tools comprising: a bucket member having a bottom wall and a side wall extending vertically from said bottom wall to an upper periphery wherein said side wall surrounds an open cavity; a manifold nested within said bucket member and substantially bifurcating said open cavity into a first volume within said manifold and a second volume between said side wall and said manifold, wherein said manifold extends vertically between an upper end disposed closer to said upper periphery than said bottom wall and a lower end disposed closer to said bottom wall than said upper periphery; at least one retaining member projecting into said second volume from one of said side wall and said manifold, said at least one retaining member being mounted on one of said side wall and said manifold and is one of a hook, a clamp, and a pin; and at least one drain extending through one of said bottom wall and said side wall; at least one aperture placing said first and second volumes in fluid communication with one another; a splash guard projecting vertically from said side wall about less than all of said upper periphery, and a handle defined by an aperture in an upper portion of said splash guard; at least one wheel supporting said bucket member for movement; and the manifold being affixed to said bucket member and having a dispersion tube mounted therein.

2. The apparatus of claim 1 wherein said manifold is substantially centered on a manifold axis extending vertically between said upper and lower ends and said side walls are substantially centered on a bucket axis extending vertically between said bottom wall and said upper periphery, wherein said manifold axis and said bucket axis are spaced laterally from one another.

3. The apparatus of claim 1 further comprising: at least one retaining member projecting outwardly from said splash guard to extend above said open cavity.

4. The apparatus of claim 1 wherein said side wall and said splash guard are integrally-formed with respect to one another.

5. The apparatus of claim 1 further comprising: a notch defined in said upper periphery adjacent to said manifold.

6. The apparatus of claim 5 wherein said notch extends substantially perpendicular to said upper periphery.

7. The apparatus of claim 5 wherein said notch extends along a horizontal axis spaced from a central vertical axis of the manifold.

8. The apparatus of claim 1 wherein said at least one wheel is further defined as having an axis of rotation fixed with respect to said bucket member.

9. The apparatus of claim 1 wherein said side wall includes an outer surface and a portion opposite said open cavity and recessed from said outer surface and wherein said at least one wheel is disposed in said portion such that an outer wall of said at least one wheel is one of flush or recessed relative to said outer surface.

10. The apparatus of claim 1 wherein said open cavity extends from said bottom wall to said upper periphery along a vertically-oriented bucket axis with cross-sections of said open cavity defined in planes perpendicular to said bucket axis and wherein said open cavity is at least partially non-circular in a plurality of said cross-sections.

11. The apparatus of claim 10 wherein said open cavity is at least partially circular in a plurality of said cross-sections.

12. The apparatus of claim 10 wherein said open cavity includes a plurality of differently shaped cross-sections such that said open cavity converges at said bottom wall.

13. The apparatus of claim 1 wherein said dispersion tube extends along a length axis between first and second ends wherein said first end is disposed closer to said upper end of said manifold than said lower end and said second end is disposed closer to said lower end than said upper end;

a plurality of orifices extending through said dispersion tube and each directed along a dispersion axis being transverse to said length axis; and a fluid fitting positioned at said first end of said dispersion tube.

* * * * *